US007222891B2

(12) United States Patent
Johansson

(10) Patent No.: US 7,222,891 B2
(45) Date of Patent: May 29, 2007

(54) FLUSH MOUNT SLIDING PANEL LATCH

(75) Inventor: Henric Johansson, Husby-Rekarne (SE)

(73) Assignee: Southco, Inc., Concordville, PA (US)

( * ) Notice: Subject to any disclaimer, the term of this patent is extended or adjusted under 35 U.S.C. 154(b) by 54 days.

(21) Appl. No.: 10/971,999

(22) Filed: Oct. 23, 2004

(65) Prior Publication Data

US 2006/0086161 A1 Apr. 27, 2006

(51) Int. Cl.
*E05C 19/00* (2006.01)

(52) U.S. Cl. ..... 292/304; 292/24; 292/27; 292/DIG. 31; 292/336.3

(58) Field of Classification Search ..... 292/304, 292/336.3 X, DIG. 30, DIG. 53, DIG. 60, 292/DIG. 64, 123, 126, 26, 29, 24, 25, 27, 292/49, DIG. 31; 70/69–75, 95
See application file for complete search history.

(56) References Cited

U.S. PATENT DOCUMENTS

| | | | | | |
|---|---|---|---|---|---|
| 1,038,624 | A | | 9/1912 | Messick | |
| 1,910,282 | A | * | 5/1933 | Ellis | 220/210 |
| 2,722,445 | A | * | 11/1955 | Cudney | 292/229 |
| 2,871,048 | A | * | 1/1959 | Balogh | 292/173 |
| 3,065,985 | A | | 11/1962 | Du Four | |
| 3,857,594 | A | * | 12/1974 | Pastva, Jr. | 292/27 |
| 3,869,152 | A | * | 3/1975 | DeVincent et al. | 285/124.3 |
| 4,024,739 | A | | 5/1977 | Kaufman | |
| 4,418,951 | A | | 12/1983 | Schultz et al. | |
| 4,480,862 | A | | 11/1984 | Fleming | |
| 4,783,029 | A | * | 11/1988 | Geppert et al. | 248/74.1 |
| 4,969,916 | A | * | 11/1990 | Weinerman et al. | 70/208 |
| 4,989,907 | A | * | 2/1991 | Edmonds et al. | 292/223 |
| 4,995,649 | A | | 2/1991 | Magnusson | |
| 5,104,165 | A | * | 4/1992 | Anderson et al. | 292/337 |
| 5,171,048 | A | * | 12/1992 | Weinerman et al. | 292/45 |
| 5,209,530 | A | * | 5/1993 | Kolloch | 292/27 |
| D354,428 | S | | 1/1995 | Magnusson | |
| 5,603,184 | A | | 2/1997 | Campbell et al. | |
| 5,676,408 | A | | 10/1997 | Davidian | |
| 5,820,175 | A | * | 10/1998 | Clavin | 292/165 |
| 6,050,618 | A | | 4/2000 | Tieu | |

(Continued)

OTHER PUBLICATIONS

Mobella by Southco Marine, Marine Locks, Latches & Accessories brochure, published 4th quarter 2003. Front cover, back cover, pp. 24-27 and 33-39.

*Primary Examiner*—Brian E. Glessner
*Assistant Examiner*—Mark Williams
(74) *Attorney, Agent, or Firm*—Paul & Paul

(57) ABSTRACT

A flush mounted latch for a sliding panel or pocket door includes a snap-in, installation, from the edge of the panel or door. A slide handle operates a pair juxtaposed, pivoting, keeper-engaging, hooks to open them. The handle carries a lock rod which is engaged by a privacy knob operated from the inside of the latch or a lock cylinder/lock plug operated from the outside of the latch. A case/housing encloses the latch mechanism with two walls. Each case wall has side top-edge flanges that seat on respective face of the door. A plurality of screws and threaded studs are utilized to adjust the distance between the two opposing flanged housing walls to accommodate variances in door thickness. A first gasket seals the case/housing adjacent its outside wall. A second gasket seals the case housing and slide handle adjacent the inside wall. Cover plates are included on both sides of the latch.

17 Claims, 10 Drawing Sheets

U.S. PATENT DOCUMENTS

| | | | | |
|---|---|---|---|---|
| 6,109,669 | A | 8/2000 | Pinkow | |
| 6,182,590 | B1 * | 2/2001 | Patera | 114/55.57 |
| 6,598,896 | B1 * | 7/2003 | Hyslop | 280/414.1 |
| 6,631,931 | B2 * | 10/2003 | Magnusson | 292/175 |
| 6,837,526 | B2 * | 1/2005 | Markbreit | 292/1.5 |
| 2002/0070563 | A1 | 6/2002 | Vitry | |
| 2004/0119297 | A1 | 6/2004 | Bella et al. | |
| 2004/0128916 | A1 | 7/2004 | Fullick | |
| 2004/0148865 | A1 | 8/2004 | Duncan et al. | |

* cited by examiner

Latch Locked

Latch Unlocked

Handle Position Closed

Handle Position Open

Gasket for Handle and Privacy Knob

Gasket for Latch

FLUSH MOUNT SLIDING PANEL LATCH

BACKGROUND OF THE INVENTION

The present invention is directed to latches used for sliding panels and pocket doors, especially those found on boats, recreational vehicles (RVs) and travel trailers and the like. Generally, such latches are required to have a low profile, fit flush with the respective inside and outside surfaces of the sliding door or panel and operate easily with a twist or a sliding operator motion to open and close the latch.

Usually, the external dimensions of the door guide frame define the thickness of the door to be mounted therein. The thickness of the door, in turn, defines the size of the recess in the door to which to mount a lock or latch. This profile must leave room for the protrusion of a key lock on the outside and a privacy switch or knob on the inside.

In most instances the thickness of a latch or lock was defined by the thickness of a door panel. One lock would fit a door of only a specific thickness. In the past this limited the applications of a particular lock or latch.

Locks/latches were made adaptable to a wider variety of door thicknesses by utilizing shim plates or spacer structures. Generally, a shim plate would be placed between the outside face of the latch case and the inside wall of the cavity cut into the door. This produced a rather unfinished installation which would then require a cover plate with a filler wall that would extend into the cavity or cutout cut in the door. When the cutout in the door was uniformly sized the shim plate would build out the outside face of the casing and would require special mounting cover plates that engage the case and shim plate.

Spacers have been used to space apart the respective inside and outside faces of a latch case in order to make the case thicker to fit a thicker door. This requires not only a variety of case screws, but also a design of the internal operating components which operate equally as well without the internal case spacer/expander, and with expenders of different sizes.

Generally these latches have been mounted into a cavity or cutout in a door panel with mounting screws. Even where a mounting bracket has been engaged, that mounting bracket has been used with mounting screws.

None of the prior art latches and locks have been made water proof or weather resistant which is a particularly advantages feature on boats and with RVs and travel trailers where little over hangs or weather slashing is encountered.

It is therefore an objective of the present invention to provide a latch for a sliding panel or pocket door that is quickly and easily installed with a snap in installation.

It is also an objective of the present invention to provide this latch with the ability to be easily adjusted to differing door thicknesses without exchanging or adding parts or changing the operation of the latch.

It is further an objective of the present invention to provide weather proofing or water sealing to this latch.

It is even further an objective of the present invention to provide all of these features in a low profile flush mounted latch.

SUMMARY OF THE INVENTION

The objectives of the present invention are realized in a flush mounted latch for a sliding panel or pocket door, of the type often installed on boats, RV's and travel trailers. The latch of the present invention fits into a cutout opening extending from the keeper-proximate, edge of the door. A pronged receiver bracket is first placed into a specially prepared installation cutout. The latch structure slides into the cutout and snaps into place by engaging hook members on the prongs of the bracket. When interlocked therewith, the latch structure is fixedly held within the cutout.

The latch structure includes a case having an outside cover plate and an inside guide plate for a slidable operating plate carried thereon. Side top-edge flanges on each case plate of the latch structure engage the respective outside faces of the door about the cutout opening. Adjustment screws move the inside and outside plates of the case together to create a tight installation by bringing the flanges into pressure contact with the door face around the cutout. Cover plates, carried one each on a respective inside and outside case plate, dress the installation including the door edge.

The operating plate rides between parallel longitudinal flanges on the inside case guide plate. An enlarged opening in each of the inside and outside case plates permits access to the operating plate and an operating distance movement for a handle for the operating plate. The latch structure includes both an inside and outside pocket or cup-type handle mounted into the operating plate and utilized to operate the latch from either side of the door. The individual ones of this pair of handles are offset from one another to permit a narrower profile.

The operating plate is spring biased to a closed position. An operator slides either the inside handle or the outside handle away from the door edge to operate the latch to permit disengagement with a doorjamb keeper in order to open the door.

A juxtaposed pair of hooks or hook-shaped pawls are pivotally positioned to operate in tandem at the door jamb proximate end of the latch. These hooks jointly engage a bar shaped keeper on the doorjamb, and are spring biased to the closed or locked position. The hooks each include an outer tab that is engaged by a respective tab on the operating plate. When the operating plate is moved (slid) in a direction away from the doorjamb end of the latch, the each hook is simultaneously pulled and rotated to the open position, thereby opening the latch.

The operating plate has two projecting posts or lock rods on its end opposite the doorjamb end. The latch includes a lock plug or lock cylinder extending through its outside case plate. This lock plug includes a follower ring with an offset tab. The offset tab is positioned to intercept one of the lock rods when the lock cylinder is rotated to the locked position. The latch also includes a rocker switch or privacy knob mounted through its inside case plate. The rocker switch intercepts the other lock rod when in the locked position. Either the lock plug follower arm or the privacy knob structure can be selectively moved to intercept the movement of the projecting post or lock rod. When this occurs the operating plate cannot be moved to pull on the hooks to open the latch. Thereby the latch is locked.

The latch is made weather or water resistant by utilizing two gaskets. The first gasket is U-shaped and positioned between the outside case plate and the inside case guide plate's parallel flanges. The second gasket is bladder shaped and covers the inside pocket handle opening and extends about the rocker switch, privacy knob.

BRIEF DESCRIPTION OF THE DRAWINGS

The features, advantage and operation of the present invention will become readily apparent and further understood from a reading of the following detailed description with the accompanying drawings, in which like numerals refer to like elements, and in which.

DETAILED DESCRIPTION OF THE INVENTION

Figure 1:
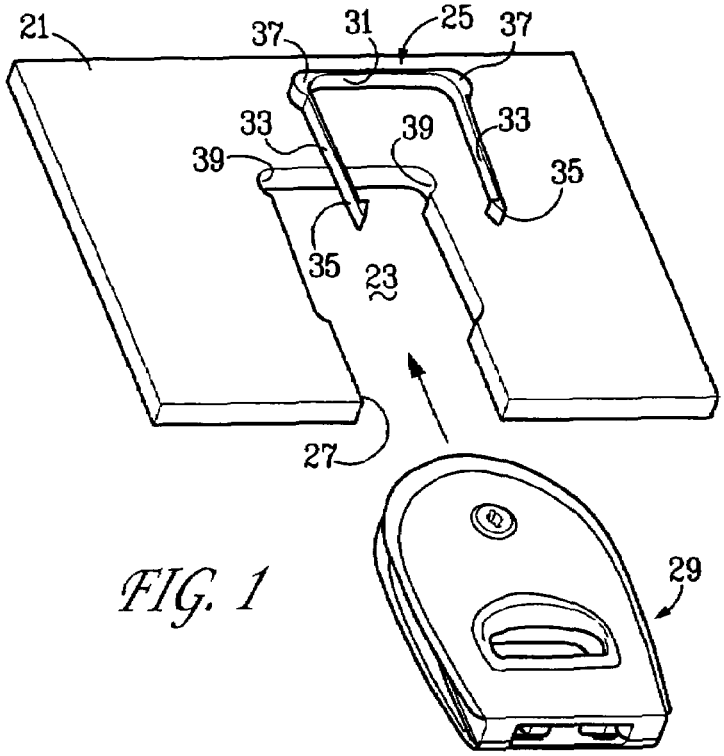
FIG. 1 is an exploded perspective view of a door panel, receiver bracket and latch assembly.
Figure 2:
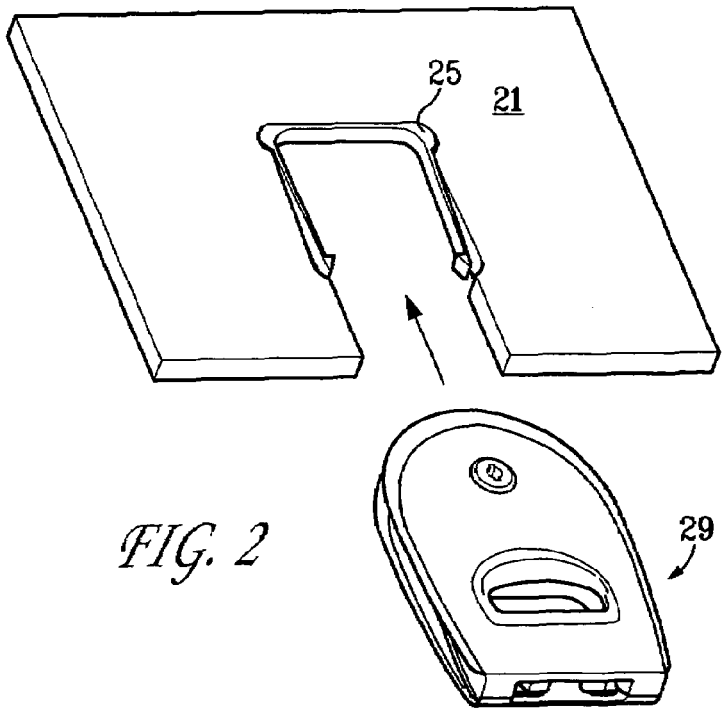
FIG. 2 is a perspective view of the receiver bracket in the door panel ready to receive the latch assembly.

The present invention is a flush mount sliding panel latch with snap in installation, weather-proofing, and selective door width adjustment. A sliding panel or pocket door 21, FIG. 1, is prepared with a shaped cutout 23 for receiving and holding a U-shaped receiver bracket 25. The shape of the cutout 23 follows the shape of the bracket 25 and allows for space for a movement of the bracket 25 arms. The lead-in portion 27 of the cutout 23 opens onto the door edge. This lead-in portion 27 is narrowed to the width of the latch assembly 29 that is slid into position, FIG. 2, from the door edge, once the receiver bracket 25 is positioned in place.

While essentially U-shaped, the bracket 25 has a relatively flat back arm 31 with a pair of spring-type ribbon-shaped side arms 33. Each side arm 33 of the bracket 25 carries a hook 35 at its free end with an inward projection and a flush outer face. A bump-out shoulder 37 extends outwardly from the back arm 31 at the bend in the bracket 25 where it turns into the side arms 33. These bump-out shoulders 37 seat in receiving pockets 39 formed as part of the shaped cutout 23. Thereby, the bracket 25 is securely held in position in the cutout 23 of the door.

Figure 3:
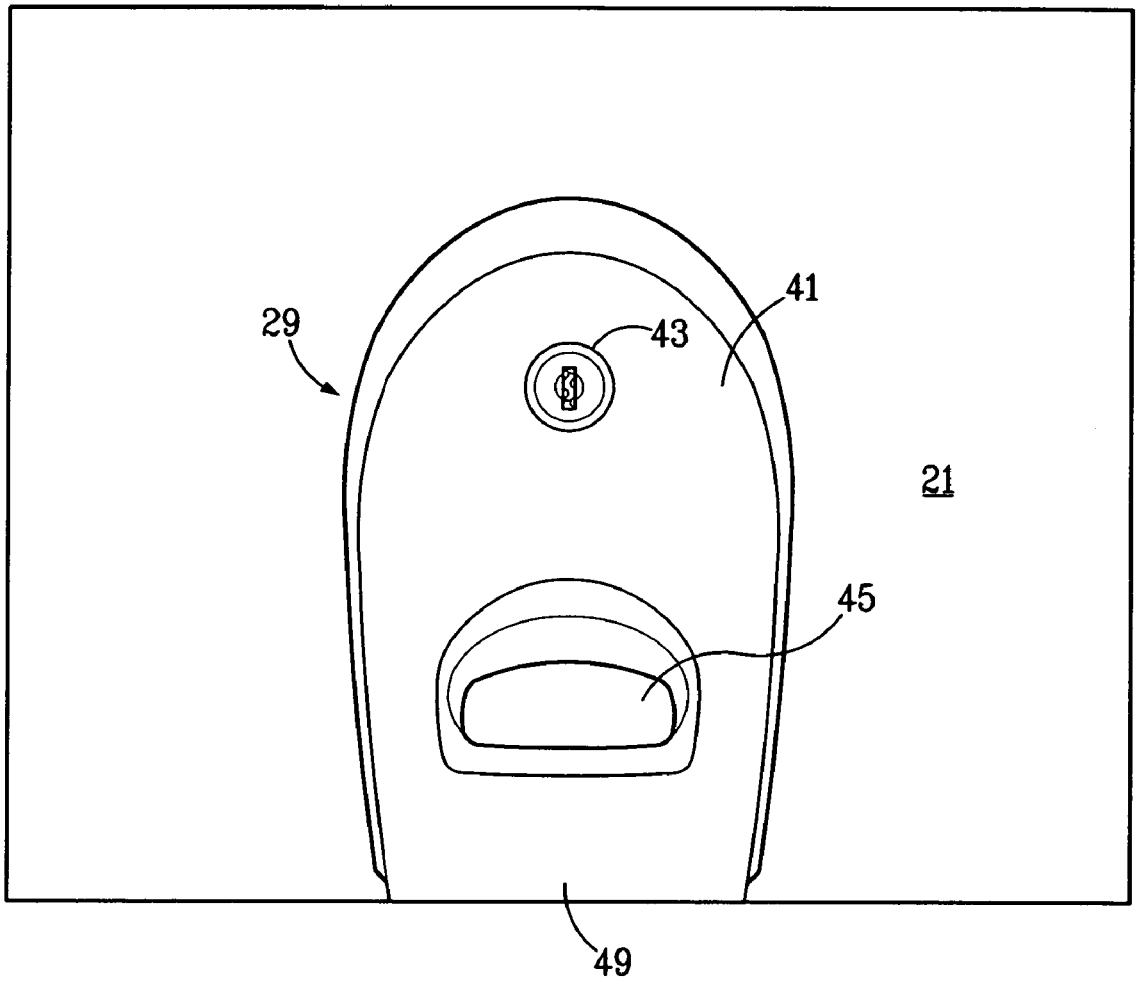
FIG. 3 is a outside view of the latch snapped into a flush mounting on a door panel.

Once the latch assembly 29 is slid in the cutout 23 to be in locked engagement with the bracket 25, the latch assembly 29 becomes fully seated on the door panel 21, FIG. 3, so that the keeper-engaging end 49 of the assembly 29 is flush with the door 21 edge. FIG. 3 shows the outside of the latch assembly 29, with an outside cover plate 41, a lock plug 43 extending above the outside cover 41, and a pocket-shaped outside handle 45 operating though an opening 47 (seen in FIG. 5) in the outside cover 41.

Figure 4A:
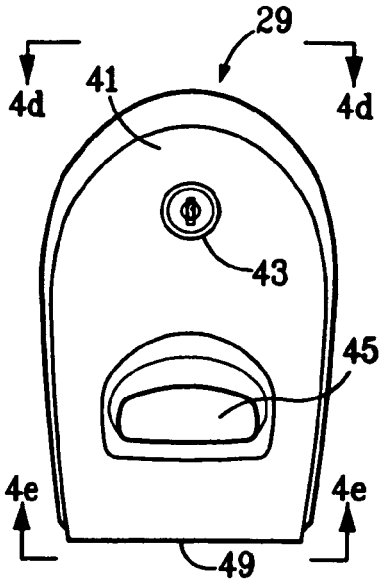
FIGS. 4*a* through 4*e* are various views of the latch assembly showing its external features.
Figure 4B:
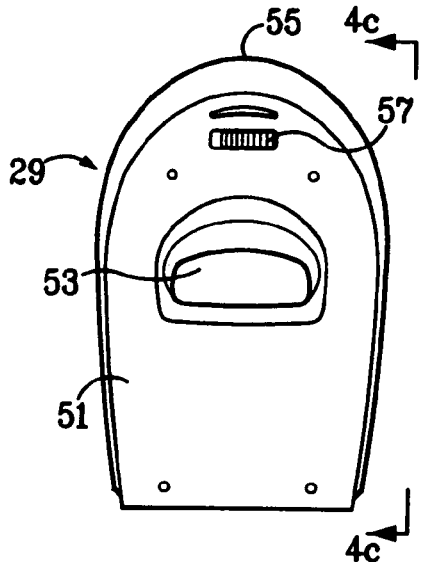
Figure 4C:
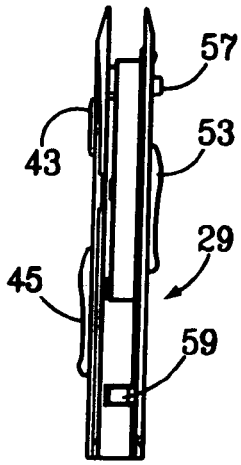
Figure 4D:
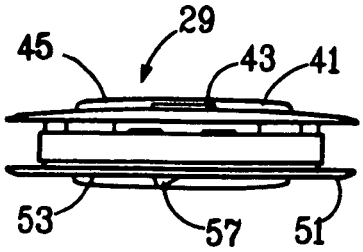
Figure 4E:
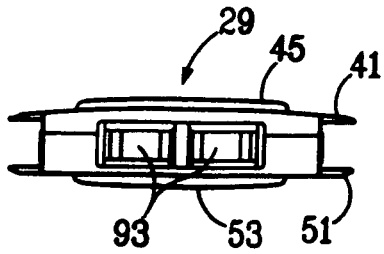

The latch assembly 29 can be seen in various views in FIGS. 4*a*-4*e*. FIG. 4*a* shows the outside face of the latch assembly 29 where of the outside pocket handle 45 is positioned offset from the center of the latch and closer to the keeper engaging end 49. FIG. 4*b* shows the inside face of the latch assembly 29, with the inside cover plate 51. An inside pocket handle 53 is positioned offset from the center of the latch and closer to the lead-in or distal end 55 of the latch assembly 29. Adjacent the distal end 55, and positioned to be outboard of the lock plug 43 located on the outside face, is a privacy knob/rocker switch 57.

The latch assembly 29 includes a pair of juxtaposed, tandem operating pawls 93 in the shape of hooks. These hooks 93 are located within the assembly and inboard from the outboard edge of the keeper-engaging end of the latch assembly 29.

The operating mechanism of the latch assembly is held within and by a case which will be discussed further below. The members of the case have a rectangular opening 59 on each side of the case, FIG. 4*c* to be engaged by the hooks 35 at the end of the side arm 33 of the receiver bracket 25.

Figure 5:
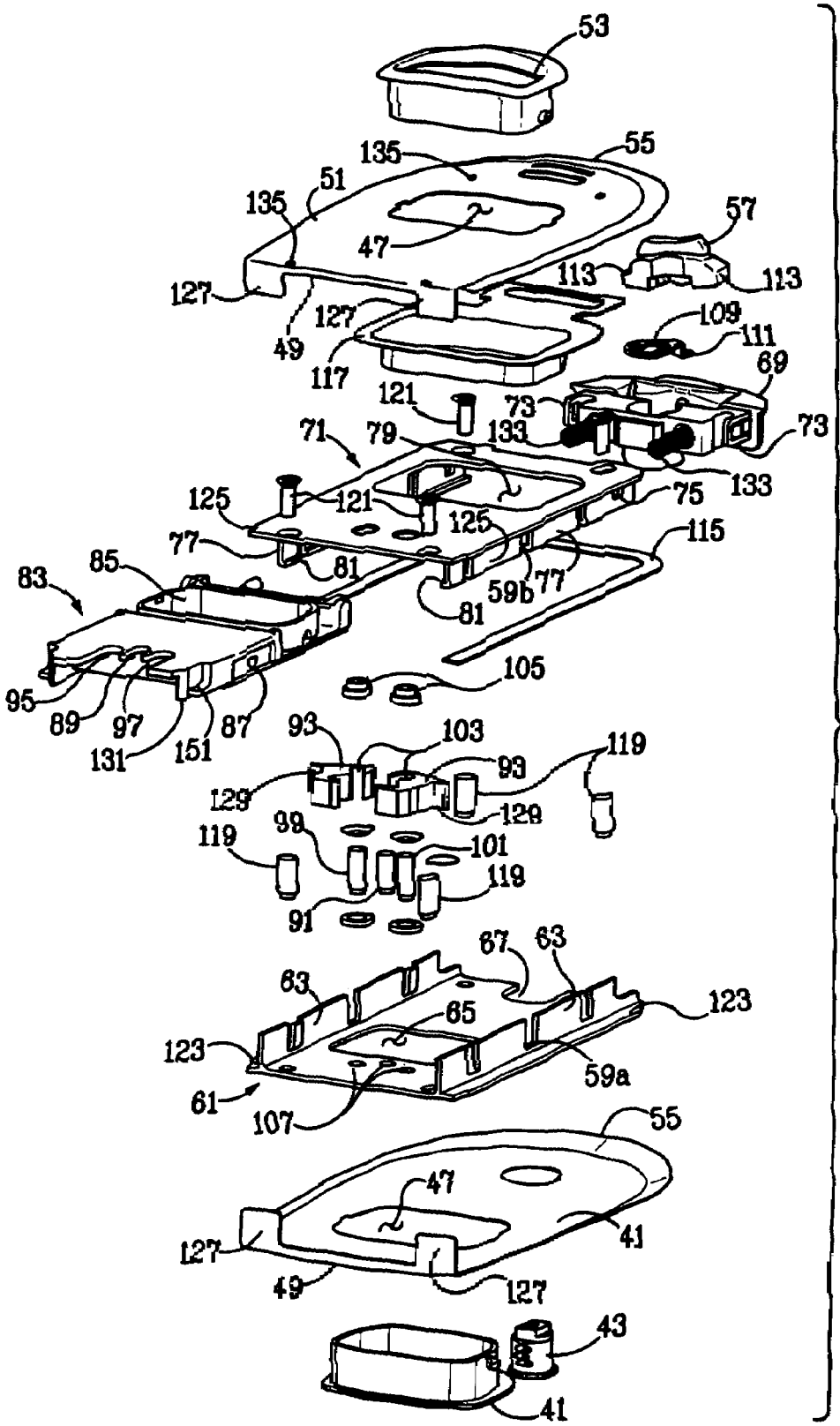
FIG. 5 is a perspective exploded view of the latch assembly showing its components and their respective locations.
Figure 6A:
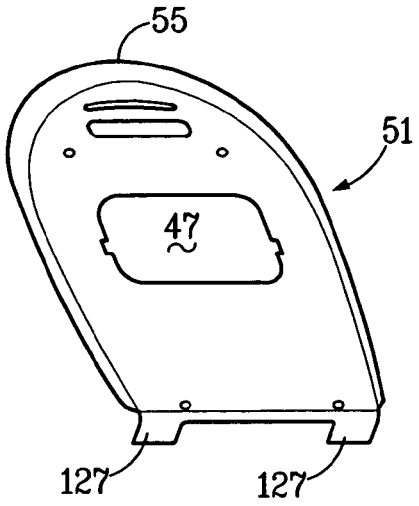
FIGS. 6*a* through 6*e* are various views of the inside or privacy knob side cover plate.
Figure 6B:
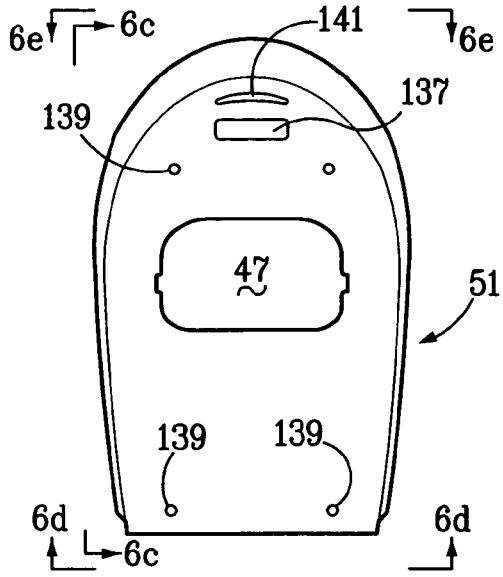
Figure 6C:
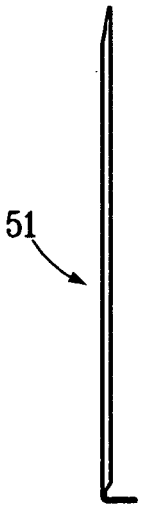
Figure 6D:
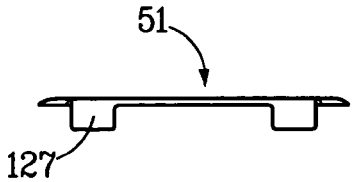
Figure 6E:
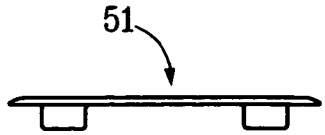
Figure 7A:
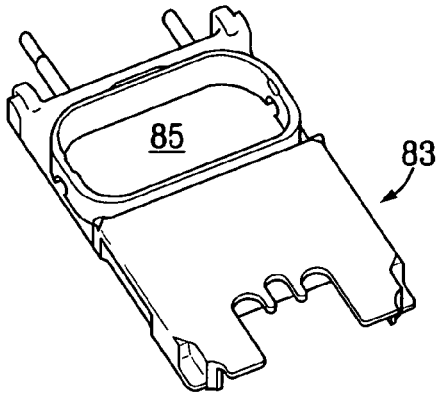
FIGS. 7*a* through 7*d* are various view of the sliding operating plate.
Figure 7B:
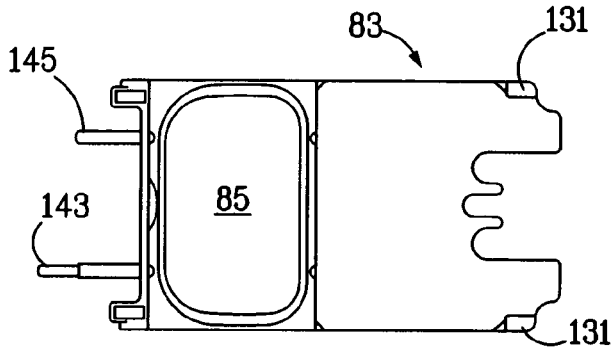
Figure 7C:
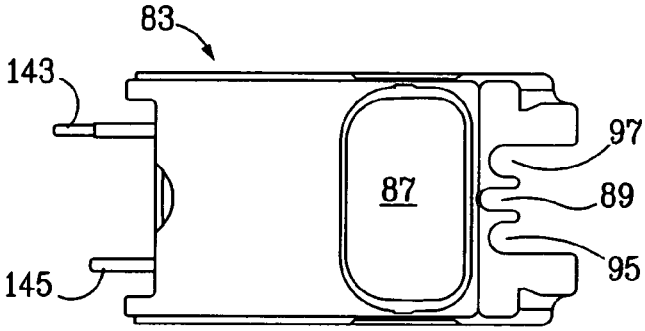
Figure 7D:
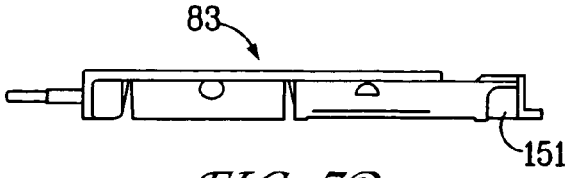

FIG. 5 is an exploded assembly view of the latch assembly 29, with the inside being at top of the view and the outside being at the bottom of the view. The latch case is assembled from an outside wall 61 having two, opposed, longitudinally extending, slotted, orthogonally formed flanges 63, which cooperate with other structure discussed below to form the side walls of the latch case. The case outside wall 61 includes an opening 65 of a size and position to align with the outside cover opening 47 when the outside cover 41 is mounted onto the outside case wall 61. A half-circle cutout 67 at the distal end of the outside wall 61 accommodates the extension of the MIM-type lock plug 43 into a MIM housing which snap mounts to the distal end of the case inside wall 71. Spring tab clips having spring hooks 73 in the each side of the MIM housing 69 engage a respective clip hole 75 in a opposed, longitudinally extending, orthogonally formed flanges 77, which cooperate with the inside wall flanges 63 to form the side walls of the latch case.

The case inside wall 71 carries an opening 79 which aligns with the opening 47 in the inside cover plate 51. The inside wall flanges 77 formed as part of the case inside wall are also slotted. The second slot 59*a* inward from the keeper-engaging end on the slotted side flanges 63 aligns with the second slot 59*b* in from the keeper-engaging end of the slotted side flanges 77 to form the rectangular openings 59 into which the receiving bracket 25 hooks 35 project to lock the case and thereby the latch assembly 29 into position.

The side flanges 77 of the case inside wall 71 are crimped over inwardly to each form an L-shaped channel 81. An operating plate or shuttle 83 slides within the side flanges 77 and rides on the crimped wall portions forming the L-shaped channels 81. The shuttle has two pockets, an inside pocket 85 near the distal end of the shuttle plate 83, and an outside pocket 87 near the keeper engaging end of the shuttle plate 83.

The keeper-engaging end of the shuttle plate carries three rounded cutouts which permit the movement of the shuttle plate 83 with respect to the pawl hook structure. A first, smaller cutout 89 (or rounded slot) on the longitudinal centerline of the shuttle plate 83 accommodates the shuttle 83 movement with respect to a pin or hook bolt 91 which assures the alignment and tandem operation of the pair of juxtaposed keeper engaging hooks 93. These hooks 93 are the latch's pawls.

The second and third cutouts 95, 97, are larger, identical and spaced outboard of the centerline cutout 89. These cutouts 95, 97 accommodate the shuttle 83 movement with respect to hook pivot pin or pivot bolts 99 and 101. The hooks 93 each include an open journal 103 in which a respective one of the pivot bolts 99, 101, extend.

A respective bushing 105 creates the slide interface with the slotted shuttle plate 83. Each bushing includes a neck projection that extends into a respective one of the second and third cutouts 95, 97 (or rounded slots). The pin hook bolt 91, and the hook pivot pin bolts 99 and 101 are each thread mounted or peen-mounted to the appropriate receiving holes in the case outside wall 61.

The lock plug 43 carries on its inside end a follower ring 109 with an offset tab 111 which when rotated to a lock position, locks the operation of the shuttle plate 83.

The rocker switch 57 carries a pair of feet 113, one of which locks the operation of the shuttle plate 83 when the switch is moved to the lock position.

The slotted flange sidewalls 63 on the case outside wall 61 are slightly outboard of the slotted flange sidewalls 77. A U-shaped gasket extends between the sidewalls of the outside and inside case walls 61, 71, and under the MIM housing 69 to form a water barrier.

A bladder-shaped gasket 117 is shaped to receive the inside pocket handle 53 and extend through the inside cover opening 47 and case inside wall opening 79 into the shuttle plate 83 inside pocket 85. This bladder gasket also has a face that extends over to and about the privacy knob or inside rocker switch 57. This inside bladder gasket 117 forms a water barrier.

The case inside wall 71 is held to the outside wall 61 by four internally threaded flush bolts 119, each received and held to the case outside wall 61; and by four screw fasteners 121 which screw into the receiving threads of the flush bolts 119.

The case outside wall 61 and inside wall 71 each have a side projecting top face flange, 123 and 125, respectively. These top face flanges 123, 125, extend outside of the respective slotted side flanges 63, 77 and grip the side edges of the door pane 21 shaped cutout 23 as the screws 121 are tightened and the two case walls 61, 71 are drawn closer together.

Each of the outer and inner covers, 41, 51 have a pair of inwardly projecting flat tabs 127. These tabs dress the keeper engaging end of the latch assembly 29 and leave and opening for a keeper to extend into the latch assembly 29 to engage the hooks 93.

Each hook 93 has a tab 129 outwardly projecting in the direction of the wall 71 slotted side flange 77. The keeper-engaging end of the shuttle plate 83 has two outer corner tabs 131 formed to extend othogonally inwardly from the top face of the shuttle plate. There is an open space 151 behind each corner tab 131. The hook tabs 129 extend, respectively, into the adjacent shuttle plate opening 151.

When either the outside or inside pocket handles 45, 53 are slide toward the distal end 55 of the latch assembly 29, the shuttle tabs 131 engage the respective hook tabs 129 thereby causing each hook 93 to rotate open to release a keeper held between the hooks 93. When the shuttle plate 83 is moved towards the keeper engaging end 49 of the latch assembly, the respective open space 151 avoids an engagement with the respective hook tabs 129 by the shuttle plate 83.

A pair of compression springs 133 bias the shuttle plate to the closed position away from the distal end. A torsion spring with hook engaging finger is mounted on each pivot bolt 101 to bias each hook to the closed position. These torsion springs are not shown. A hook 93 closed position is where the hook tab 129 is away from the distal end 55.

The latch assembly 29 is mounted to the sliding panel or sliding door 21 from the keeper adjacent edge by being slid into the shaped cutout 23 to engage the receiver bracket 25 seated with the cutout 23. This is done by sliding the case, with its wall flanges 123, 125 on the outside of the door 21 faces. The outside cover plate 41 is previously mounted to the case outside wall 61 and is carried onto the door 21 with the latch assembly 29. The inside cover plate 51 remains not yet installed.

Once the retainer bracket two hooks 35 snap into the case side two rectangular openings 59, the latch assembly is fully seated into the door 21 cutout 23. The thickness adjustment screws 121 are then tightened to tighten the case top face flanges 123, 125 against the inside and outside faces of the door 21. This completes the installation, except for the mounting of the inside cover plate 51 which is mounted to the case inside wall 71 by four small cover mounting screws 135.

The inside cover plate 51 is shown in greater detail in FIGS. 6*a*-6*e*. The overall shape of the inside cover plate 51 is reasonably identical to the outside cover plate 41. The exceptions are the location of the pocket handle opening 47, the position and shape of the rocker switch opening 137, the four mounting screw 135 holes 137, and the lock state indicator opening 141.

The operating shuttle plate 83 is shown in greater detail in FIGS. 7*a*-7*d*. The offset of the inside 85 and outside 87 pockets permits a thinner (i.e., narrower) profile for the shuttle plate 83. The shuttle tabs 131 for engaging the hook 93 tabs 129 are shown to extend inwardly, orthogonal to the top face of the shuttle plate 83.

A first, longer, lock rod 143 extends longitudinally from the distal end of the shuttle plate 83 (with the distal end being opposite the keeper engaging end carrying the rounded slots 89, 95 and 97. This lock rod 143 is positioned to the left side of the longitudinal centerline of the shuttle plate 83 when viewed looking at the inside pocket 85 face.

A second, shorter, lock rod 145 extends parallel to the first lock rod 143 at the distal end of the shuttle plate 83, but is positioned to the left of the centerline thereof.

The first lock rod 143 is intercepted by a foot 113 on the rocker switch 57, when the rocker switch 57 is in the locked position. The second lock rod 145 is intercepted by the offset tab 111 on the follower ring 109, when the lock plug 43 is in the locked position.

Figure 8:
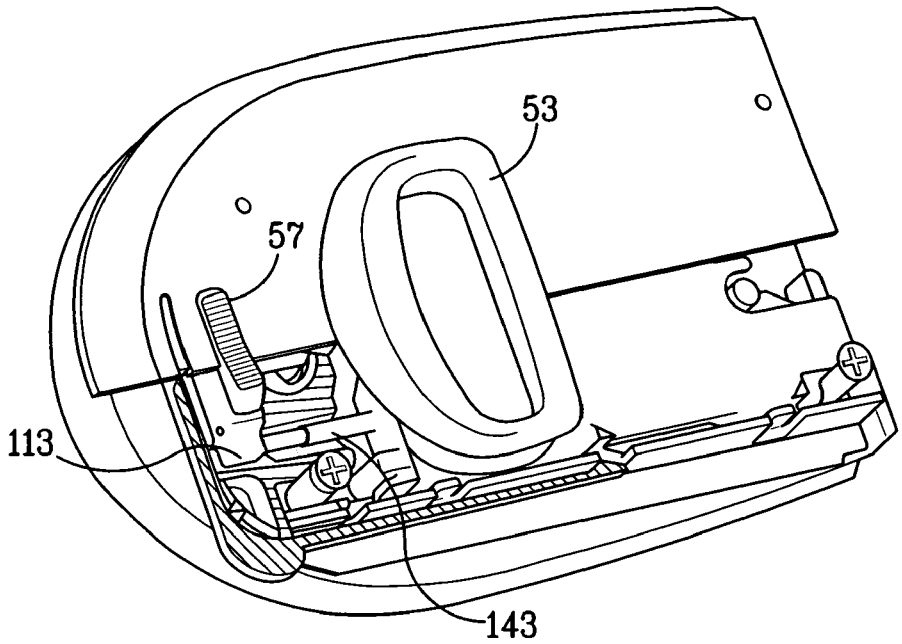
FIG. 8 is a perspective partial cut-away view of the latch assembly from the inside or rocker switch/privacy knob side of the latch and showing the latch in the locked position.
Figure 9:
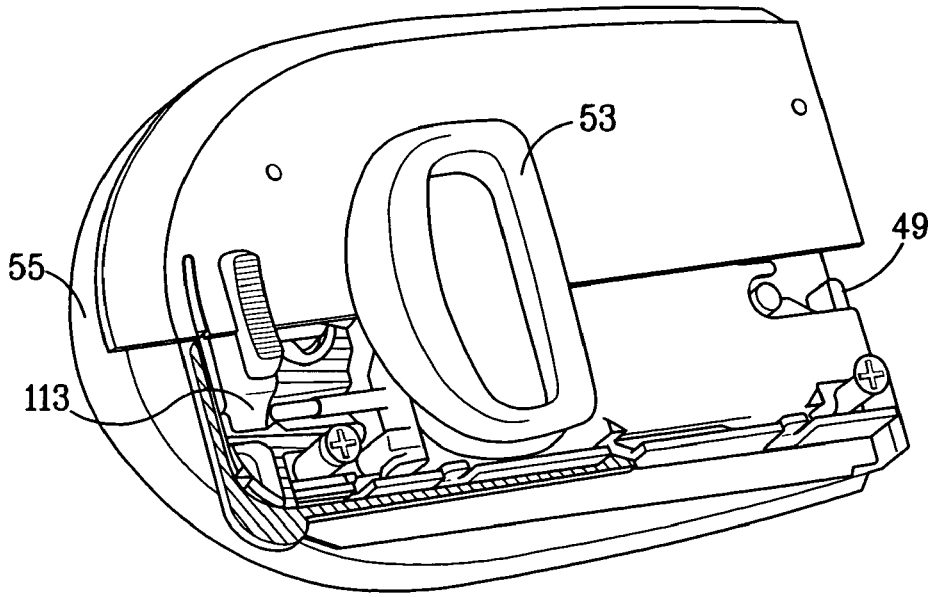
FIG. 9 is a perspective partial cut-away view of the latch assembly form the inside and showing the latch in the unlocked position.

FIGS. 8 and 9 show a partial cutaway view of the latch assembly 29 in the locked and unlocked positions, respectively. In the locked state, FIG. 8, the shuttle plate 83 first lock rod 143 abuts the foot 113 of the rocker switch 57. In the unlocked state, FIG. 9, the foot 113 of the rocker switch 57 is below the first lock rod 143 and the shuttle plate is free to move towards the distal end 55 of the latch assembly 29. This permits the pocket handle 53 to be moved towards the distal end 55 to move the shuttle plate 83 with it and to pull the hooks 93 to the rotated open position.

Figure 10A:
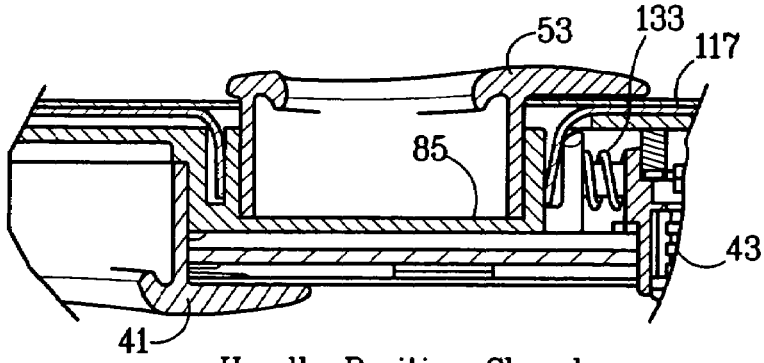
FIG. 10*a* is a partial cutaway, cross-sectional view of the inside handle when the latch in the closed position.
Figure 10B:
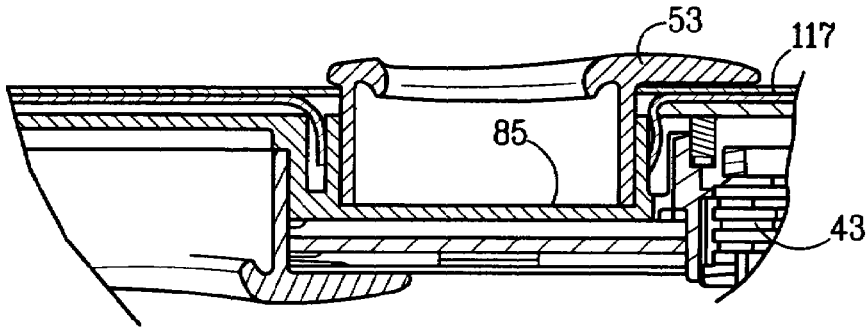
FIG. 10*b* is a partial cutaway, cross-sectional view of the inside handle when the latch is in the open/opened position.

FIG. 10*a* shows the inside handle 53 in the closed position, i.e., spring biased with the engage shuttle inside pocket 85 away from the distal end 55 of the latch assembly 29 with the latch assembly not being operated. One of the shuttle plate biasing compression springs 133 is shown to ride on one of the lock rods 145. This second lock rod 145 extends through a bore style opening in the MIM housing 69 to project into a location of the rotatable follower ring 109. The first lock rod 143 carries the other shuttle biasing spring and likewise extends through the MIM housing 69 to the distal outside end of the housing 69 to the location of the rocker switch 57.

Figure 11:
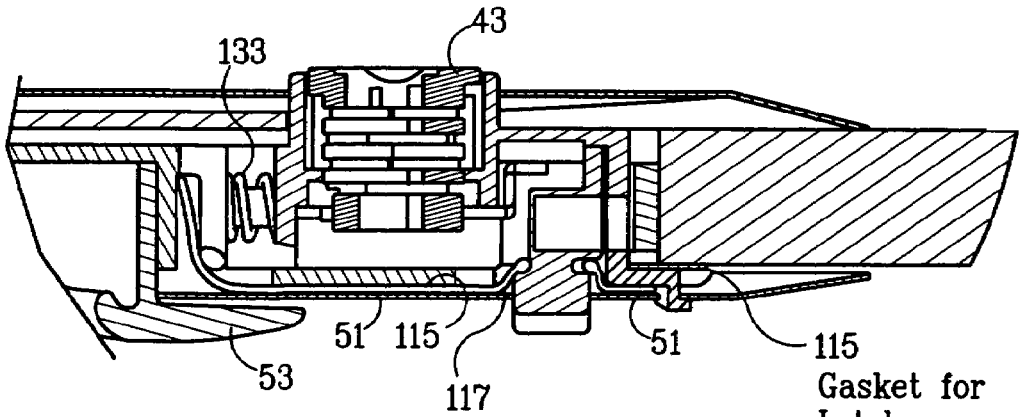
FIG. 11 is a partial cutaway, cross-sectional view showing partially the inside handle, the lock plug and the first and second gaskets in the area of the lock plug.

The relative positions of the U-shaped gasket 115 and the bladder-shaped gasket 117 are shown in the detail of FIG. 11. These gaskets 115, 117 both reside at a location near or adjacent the inside door 21 facing of the case walls 61, 71. This means that weather generated water may enter the interior of the case of the latch assembly 29, but will not run into the inside cover 51 location, but will run out the keeper engaging end 49 opening.

Figure 12:
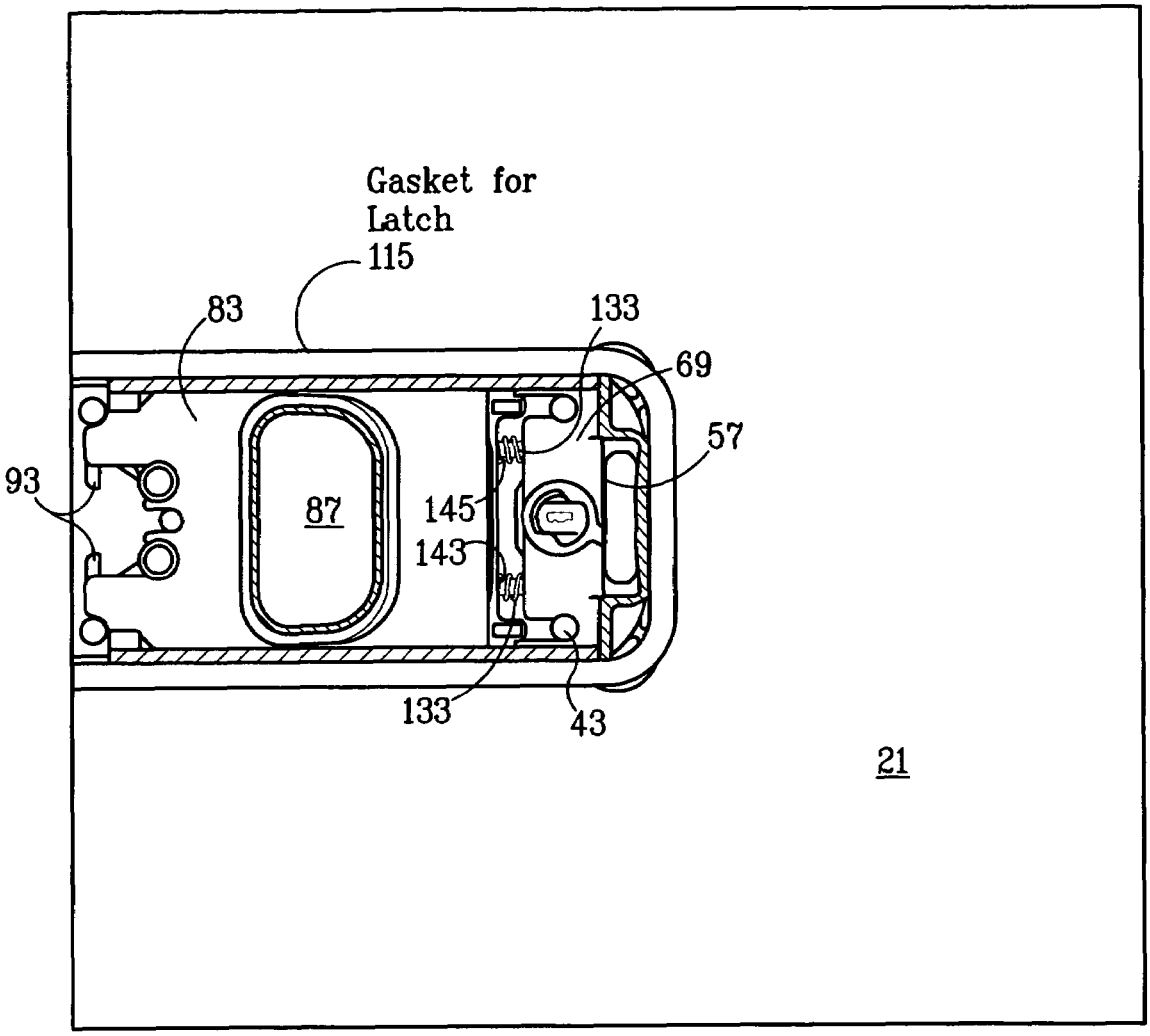
FIG. 12 is an outside view of the latch assembly with the cover plate and outside case/housing wall removed, thereby showing the first or U-shaped gasket.

FIG. 12 shows a cutaway view from the outside of the door 21 showing the assembly and relative positions of the rocker switch 57 (in dashed lines—phantom), the MIM housing 69 carrying the lock plug 43, the handle outside pocket 87 in the shuttle plate 83 in the in-operative or closed latch position. The hooks 93 forming the keeper-engaging pawl are closed. The U-shaped gasket 115 location, and the location of the of the first and second lock rods, 143, 145 and the compression biasing springs 133.

Figure 13:
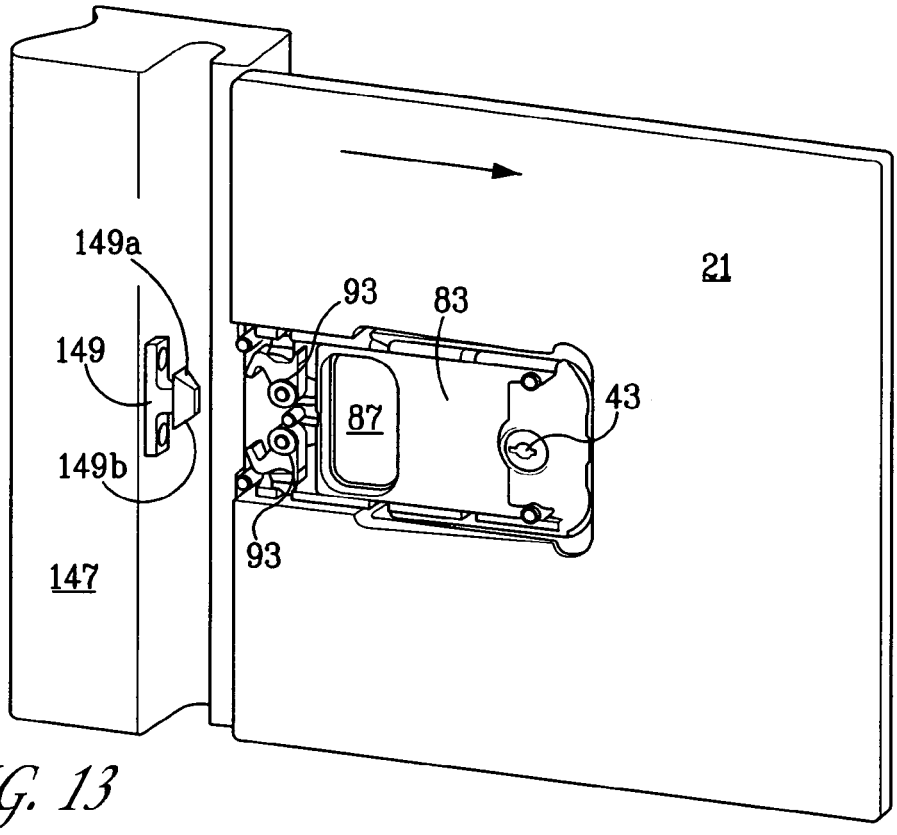
FIG. 13 is a perspective outside view of a sliding panel approaching a keeper jamb, with the outside cover plate and outside case wall removed to show the twin pawls/hooks in the open position.
Figure 14:
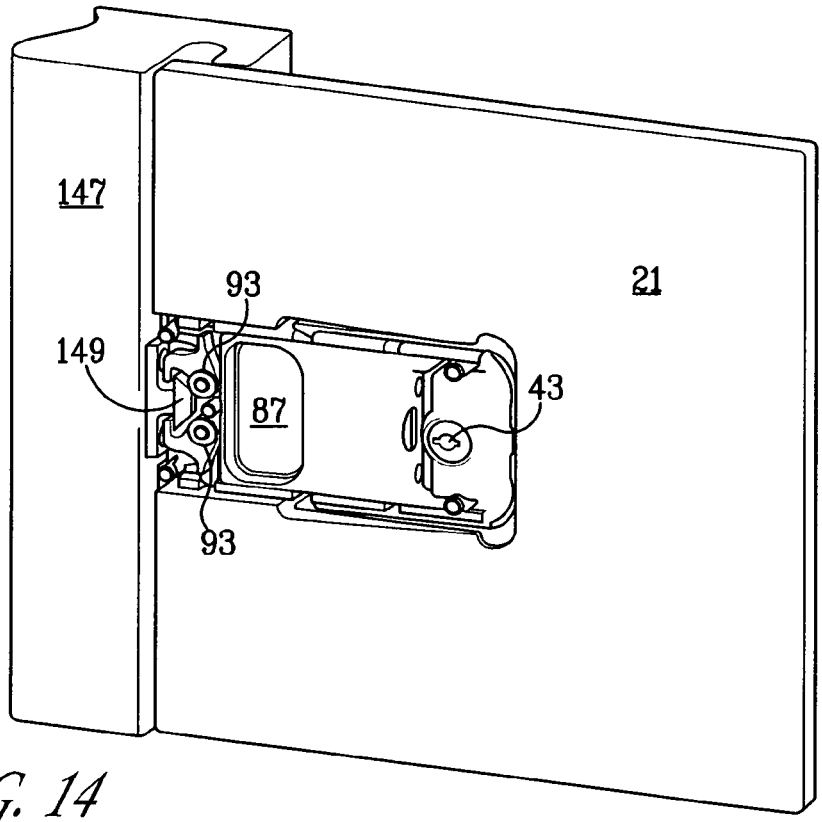
FIG. 14 is a perspective outside view of the structure of FIG. 13 with the twin hooks engaging the keeper whereby the panel is latched closed.

FIGS. 13 and 14 are each partial cutaway views that show the sliding panel door 21, operating with a doorjamb 147, having a bar-shaped or rectangular pin shaped keeper 149. In FIG. 13, the jaws of the hooks 93 in the open position form the door to be pulled open by sliding to the right.

FIG. 14 shows the door 21 with the latch assembly 29 latched against the doorjamb 147, and the hooks 93 engaging the keeper 149.

The keeper 149 engagement head 149*a* is spade-shaped with ramp surfaces 149*b* on each outside face. When the door 21 is pulled to slide towards the doorjamb 147, the shuttle plate 83 will move towards the keeper-engaging end 49 of the latch assembly 29 a short distance. The open spaces 151 will allow the hooks 93 to each be forced open against the force of their biasing spring by the ramped surfaces 149*b* of the keeper head 149, thereby allowing the hooks 93 to grab onto the keeper engagement head.

Many changes can be made in the above-described invention without departing from the intent and scope thereof. It is therefore intended that the above description be read in the illustrative sense and not in the limiting sense. Substitutions and changes can be made while still being within the scope and intent of the invention and of the appended claims.

What is claimed is:

1. A flush mountable latch for a sliding door, comprising:

a case having an outside wall and an inside wall each wall having an inside and outside face, each wall including a flange extending outwardly from the outside face thereof in the plane of the respective wall;

a pawl mounted within said case for engaging a keeper;

a slide plate for engaging said pawl when said plate is slid to the open position, for disengaging said pawl from said keeper; and a gasket sealing the inside face of said case against weather generated water passage;

wherein said case includes an adjustment member for moving said outer wall and said inner wall apart in order to position said flanges for different door thicknesses;

also including a U-shaped bracket member, having a back arm, a pair of resilient side arms extending in parallel from said back arm, a hook member at the end of each resilient side arm, each said hook member having an inward projection and a flush back; and a bump out shoulder extending outwardly from each end of the back arm where it joins the respective side arm, each said hook member being engageable with said case.

2. A flush mountable latch for a sliding door, comprising:

a case forming an enclosure having an outside wall and an inside wall each wall having an inside and outside face, each wall including a flange extending outwardly from the outside face thereof in the plane of the respective wall;

a pawl mounted within said case for engaging a keeper;

a slide plate operating within said case for engaging said pawl when said plate is slid to the open position; and wherein said case includes an adjustment member for moving said outer wall and said inner wall apart in order to position said flanges for different door thicknesses; and wherein said slide plate is an operating plate-shuttle positioned to operate within the case enclosure, wherein said inside wail of said case includes opposing edge L-shaped channels wherein said operating plate-shuttle operates thereon.

3. The flush mountable latch of claim 2, wherein said attachment of said case outside wall to said inside wall includes a plurality of internal threaded flush bolts attached to said outside wall and a plurality of screw fasteners attached to said inside wall and engaging one each a respective one of said internal threaded flush bolts.

4. The flush mountable latch of claim 2, wherein said operating plate-shuttle carries an inside pocket on one side thereof and an outside pocket on the other side thereof, said inside and outside pockets being displaced from one another on said operating plate-shuttle, and wherein said case inside wall has an opening proximate said operating plate-shuttle inside pocket, and wherein said case outside wall has an opening proximate said operating plate-shuttle outside pocket.

5. The flush mountable latch of claim 3, wherein said screw fasteners and said internal threaded flush bolts set the separation of said case flanges.

6. The flush mountable latch of claim 5, wherein as said screw fasteners and internal threaded flush bolts are adjusted said inside wall spacing from said outside wall is adjusted, with said operating plate-shuttle being carried with said inside plate.

7. A flush mountable latch for a sliding door, comprising:

a case having an outside wall and an inside wall each wall having an inside and outside face, each wall including a flange extending outwardly from the outside face thereof in the plane of the respective wall;

a pawl mounted within said case for engaging a keeper;

a slide plate for engaging said pawl when said plate is slid to the open position, for opening said pawl, a gasket sealing the inside face of said case against weather generated water passage; wherein said case is adjustable to position said flanges for different door thicknesses;

wherein said case outside wall is attached to said inside wall thereby forming a case enclosure, and wherein said slide plate is an operating plate-shuttle positioned to operate within the case enclosure, wherein said inside wall includes opposing edge L-shaped channels wherein said operating plate-shuttle operates thereon;

wherein said attachment of said case outside wall to said inside wall includes a plurality of internal threaded flush bolts attached to said outside wall and a plurality of screw fasteners attached to said inside wall and engaging one each a respective one of said internal threaded flush bolts;

wherein said screw fasteners and said internal threaded flush bolts set the separation of said case flanges;

wherein as said screw fasteners and internal threaded flush bolts are adjusted said inside wall spacing from said outside wall is adjusted, with said operating plate-shuttle being carried with said inside plate; and wherein said pawl includes a pair of juxtaposed hooks facing each other, a pair of bushings, each mounted on said operating plate-shuttle said bushings extending to engage a respective one of said hooks.

8. The flush mountable latch of claim 7, wherein said operating plate-shuttle carries an inside pocket on one side thereof and an outside pocket on the other side thereof, said inside and outside pockets being displaced from one another on said operating plate-shuttle.

9. The flush mountable latch of claim 8, wherein said case inside wall has an opening proximate said operating plate-shuttle inside pocket, and wherein said case outside wall has an opening proximate said operating plate-shuttle outside pocket.

10. The flush mountable latch of claim 9, also including a bladder gasket extending around said case inside wall opening and into said operating plate-shuttle inside pocket.

11. The flush mountable latch of claim 10, also including a U-shaped gasket extending about said case inside wall outwardly extending flange.

12. The flush mountable latch of claim 11, also including an inside face plate mounted to said case inside wall, and an outside face plate mounted to said case outside wall, a first pocket handle extending into said gasket covered operating plate-shuttle inside pocket, and a second pocket handle extending into said operating plate-shuttle outside pocket.

13. The flush mountable latch of claim 12, wherein said case outside wall includes slotted flanges which extend outboard of said case inside wall L-shaped channels, and wherein said latch also includes a lock member mounted to said case for intercepting said slide plate for selectively prohibiting the opening movement thereof.

14. The flush mountable latch of claim 13, also including a MIM housing and a MIM-type lock plug.

15. A flush mountable latch for a sliding door, comprising;

a case having an outside wall and an inside wall each wall having an inside and outside face, each wall including a flange extending outwardly from the outside face thereof in the plane of the respective wall;

a pawl mounted within said case for engaging a keeper;

a slide plate for engaging said pawl when said plate is slid to the open position, for opening said pawl;

a gasket sealing the inside face of said case against weather generated water passage; wherein said case is adjustable to position said flanges for different door thicknesses;

wherein said case outside wall is attached to said inside wall thereby forming a case enclosure, and wherein said slide plate is an operating plate-shuttle positioned to operate within the case enclosure, wherein said inside wall includes opposing edge L-shaped channels wherein sad operating plate-shuttle operates thereon;

wherein said operating plate-shuttle carries an inside pocket on one side thereof and an outside pocket on the other side thereof, said inside and outside pockets being displaced from one another on said operating plate-shuttle, and wherein said case inside wall has an opening proximate said operating plate-shuttle inside pocket, and wherein said case outside wall has an opening proximate said operating plate-shuttle outside pocket; and also including a bladder gasket extending around said case inside wall opening and into said operating plate-shuttle inside pocket.

16. The flush mountable latch of claim 15, also including a U-shaped gasket extending about said case inside wall outwardly extending flange.

17. The flush mountable latch of claim 16, also including an inside face plate mounted to said case inside wall, and an outside face plate mounted to said case outside wall, a first pocket handle extending into said gasket covered operating plate-shuttle inside pocket, and a second pocket handle extending into said operating plate-shuttle outside pocket, and wherein said case outside wall includes slotted flanges which extend outboard of said case inside wall U-shaped channels, and wherein said latch also includes a lock member mounted to said case for intercepting said slide plate for selectively prohibiting the opening movement thereof.

* * * * *

UNITED STATES PATENT AND TRADEMARK OFFICE

CERTIFICATE OF CORRECTION

PATENT NO. : 7,222,891 B2
APPLICATION NO. : 10/971999
DATED : May 29, 2007
INVENTOR(S) : Henric Johansson It is certified that error appears in the above-identified patent and that said Letters Patent is hereby corrected as shown below:

Column 8
Claim 6, line 2, insert --whereby-- after “adjusted”.

Signed and Sealed this

Twenty-ninth Day of July, 2008

JON W. DUDAS
*Director of the United States Patent and Trademark Office*

UNITED STATES PATENT AND TRADEMARK OFFICE

CERTIFICATE OF CORRECTION

PATENT NO. : 7,222,891 B2
APPLICATION NO. : 10/971999
DATED : May 29, 2007
INVENTOR(S) : Henric Johansson It is certified that error appears in the above-identified patent and that said Letters Patent is hereby corrected as shown below:

Column 8
Claim 6, line 50, insert --whereby-- after "adjusted".

This certificate supersedes the Certificate of Correction issued July 29, 2008.

Signed and Sealed this

Twenty-sixth Day of August, 2008

JON W. DUDAS
*Director of the United States Patent and Trademark Office*